United States Patent [19]

Manska

[11] Patent Number: 4,691,979

[45] Date of Patent: Sep. 8, 1987

[54] COMPLIANT PRESS-FIT ELECTRICAL CONTACT

[75] Inventor: Wayne E. Manska, Anaheim, Calif.

[73] Assignee: Manda R & D, Anaheim, Calif.

[21] Appl. No.: 520,151

[22] Filed: Aug. 4, 1983

[51] Int. Cl.[4] ..... H01R 13/41

[52] U.S. Cl. ..... 439/82; 439/873

[58] Field of Search ..... 339/17 C, 220 R, 221 R, 339/221 M, 220 A, 220 C, 220 L, 220 T, 252 R, 252 P

[56] References Cited

U.S. PATENT DOCUMENTS

| | | | |
|---|---|---|---|
| 3,288,915 | 11/1966 | Hatfield et al. | 339/276 R |
| 3,371,152 | 2/1968 | Damiano | 339/221 R |
| 3,444,504 | 5/1969 | Lynch et al. | 339/64 |
| 3,761,872 | 9/1973 | Ebinger | 339/276 T |
| 3,783,433 | 1/1974 | Kurtz et al. | 339/17 C |
| 3,792,412 | 2/1974 | Madden | 339/17 C |
| 3,824,554 | 7/1974 | Shoholm | 339/221 R |
| 3,910,665 | 10/1975 | Stull | 339/17 C |
| 3,997,229 | 12/1976 | Narozny et al. | 339/19 |
| 4,017,143 | 4/1977 | Knowles | 339/17 C |
| 4,057,315 | 11/1977 | Miller et al. . | |
| 4,066,326 | 1/1978 | Lovendusky . | |
| 4,076,356 | 2/1978 | Tamburro | 339/17 C |
| 4,166,667 | 9/1979 | Griffin | 339/221 R |
| 4,183,610 | 1/1980 | Key | 339/221 R |
| 4,186,982 | 2/1980 | Cobaugh et al. . | |
| 4,191,440 | 3/1980 | Schramm | 339/17 C |
| 4,223,970 | 9/1980 | Walter | 339/220 R |
| 4,381,134 | 4/1983 | Anselmo et al. | 339/220 R |
| 4,464,009 | 8/1984 | Thaler | 339/252 |
| 4,475,780 | 10/1984 | Walter et al. . | |
| 4,513,499 | 4/1985 | Roldon . | |
| 4,585,293 | 4/1986 | Czeschka et al. | 339/221 R |

FOREIGN PATENT DOCUMENTS

| | | |
|---|---|---|
| 1184987 | 4/1985 | Canada . |
| 0001885 | 5/1979 | European Pat. Off. . |
| 0005356 | 11/1979 | European Pat. Off. . |
| 0021344 | 1/1981 | European Pat. Off. . |
| 0023296 | 2/1981 | European Pat. Off. . |
| 0040942 | 12/1981 | European Pat. Off. . |
| 0043165 | 1/1982 | European Pat. Off. . |
| 0047469 | 3/1982 | European Pat. Off. . |
| 0068656 | 1/1983 | European Pat. Off. . |
| 0084318 | 7/1983 | European Pat. Off. . |
| 0088582 | 9/1983 | European Pat. Off. . |
| 0089491 | 9/1983 | European Pat. Off. . |
| 0092150 | 10/1983 | European Pat. Off . |
| 0095282 | 11/1983 | European Pat. Off. . |
| 0105044 | 4/1984 | European Pat. Off. . |
| 0110187 | 6/1984 | European Pat. Off. . |
| 0125098 | 11/1984 | European Pat. Off. . |
| 0124767 | 11/1984 | European Pat. Off. . |
| 0132664 | 2/1985 | European Pat. Off. . |

(List continued on next page.)

OTHER PUBLICATIONS

"Sicher auch bei schnellen Pulser", Electrotechnik Article, pp. 16–18, 21, 22, Feb. 1981.

"Omron Press-Fit Pin Concept", Advanced Information Sheet, by Omron Electronics, Inc.

"An Analysis of Press-Fit Technology," by Ram Goel.

(List continued on next page.)

*Primary Examiner*—Gil Weidenfeld
*Assistant Examiner*—Gary F. Paumen
*Attorney, Agent, or Firm*—Knobbe, Martens, Olson & Bear

[57] ABSTRACT

A compliant, press fit, electrical contact includes a relief groove which forms an area of reduced cross sectional thickness to provide a stress concentration, and thus a controlled region of plastic flow, to create a plastic-elastic hinge. When the contact is inserted into a plated through hole in a printed circuit board, the hinge elastically deforms until a predetermined push-in force is reached, at which time a controlled plastic flow begins. Once the point of plastic flow is reached, the amount of additional push in force required for additional deflection of the hinge is greatly reduced, so that smaller hole sizes may be accommodated with a relatively small additional push in force. However, the required minimum pull out force is maintained for the entire range of hole sizes, since elastic energy remains stored in the hinge, even after plastic flow begins. The contact is manufactured through a series of simple coining and punching operations, so that complex rounding and rolling operations are avoided.

25 Claims, 23 Drawing Figures

FOREIGN PATENT DOCUMENTS

| | | |
|---|---|---|
| 0132704 | 2/1985 | European Pat. Off. . |
| 0134094 | 3/1985 | European Pat. Off. . |
| 0102786 | 3/1985 | European Pat. Off. . |
| 0139786 | 5/1985 | European Pat. Off. . |
| 0141492 | 5/1985 | European Pat. Off. . |
| 0140473 | 5/1985 | European Pat. Off. . |
| 0059462 | 10/1985 | European Pat. Off. . |
| 3221844 | 12/1964 | Fed. Rep. of Germany . |
| 2228953 | 1/1974 | Fed. Rep. of Germany . |
| 2345527 | 3/1975 | Fed. Rep. of Germany . |
| 2545505 | 4/1976 | Fed. Rep. of Germany . |
| 2543421 | 4/1976 | Fed. Rep. of Germany . |
| 2541222 | 7/1976 | Fed. Rep. of Germany . |
| 2656736 | 7/1977 | Fed. Rep. of Germany . |
| 2713728 | 10/1978 | Fed. Rep. of Germany . |
| 2800683 | 8/1979 | Fed. Rep. of Germany . |
| 2822245 | 10/1979 | Fed. Rep. of Germany . |
| 2825867 | 12/1979 | Fed. Rep. of Germany . |
| 3006437 | 9/1980 | Fed. Rep. of Germany . |
| 2937883 | 4/1981 | Fed. Rep. of Germany . |
| 8105896 | 2/1982 | Fed. Rep. of Germany . |
| 8209059 | 6/1982 | Fed. Rep. of Germany . |
| 3210348 | 8/1983 | Fed. Rep. of Germany . |
| 3220672 | 12/1983 | Fed. Rep. of Germany . |
| 3228581 | 2/1984 | Fed. Rep. of Germany . |
| 3241061 | 5/1984 | Fed. Rep. of Germany . |
| 8404681 | 11/1984 | Fed. Rep. of Germany . |
| 3318135 | 11/1984 | Fed. Rep. of Germany . |
| 3220781 | 12/1984 | Fed. Rep. of Germany . |
| 3326598 | 2/1985 | Fed. Rep. of Germany . |

OTHER PUBLICATIONS

Presented at Electronic Components Conference, Atlanta, Georgia, May 11–13, 1981.

"Round Hole/Round Pegs—The Second Generation," by Gary W. Schwindt, Winchester Electronics Division of Litton Industries, Oakville, Connecticut, (Undated).

"Solderless Connections—Understand and Compare . . . ," by Krish Kawlra, Control Data Corporation, St. Paul, Minnesota, (Undated).

"Press-Fit Pins in Printed Circuit Boards—Third, Fourth, Fifth and Sixth Test Series," by P. J. Tamburro, Bell Labortories, Whippany, New Jersey, (undated).

Brochure entitled "Ernipress" (14 pages).

Drawings by Brown Boveri (4 sheets).

Vogt AG CH-4654, Lostorf/Schweiz, (5 sheets), pp. 112–115, and 505.

AMP product sheet for Spulenkorperkontakte, (1 sheet).

Brochure entitled, "Schnittelle an den Leiterplatten".

Brochure entitled, "Die lotfreie Nschlusstechnik for Leiterplatten".

Collection of Abstracts for U.S. Pat. Nos.: 3,399,371; 3,400,358; 3,416,122; 3,580,297; 3,629,811; 3,660,726; 3,634,819; 3,670,294; 3,673,548; 3,731,261; 3,783,433; 3,827,004; 3,862,792; 3,864,014; 3,917,375; 3,997,237; 4,045,868; 4,106,842; 4,057,315; 4,097,101; 4,155,321; 4,175,810; 4,186,982; 4,274,699; 4,223,970.

Fig. 1
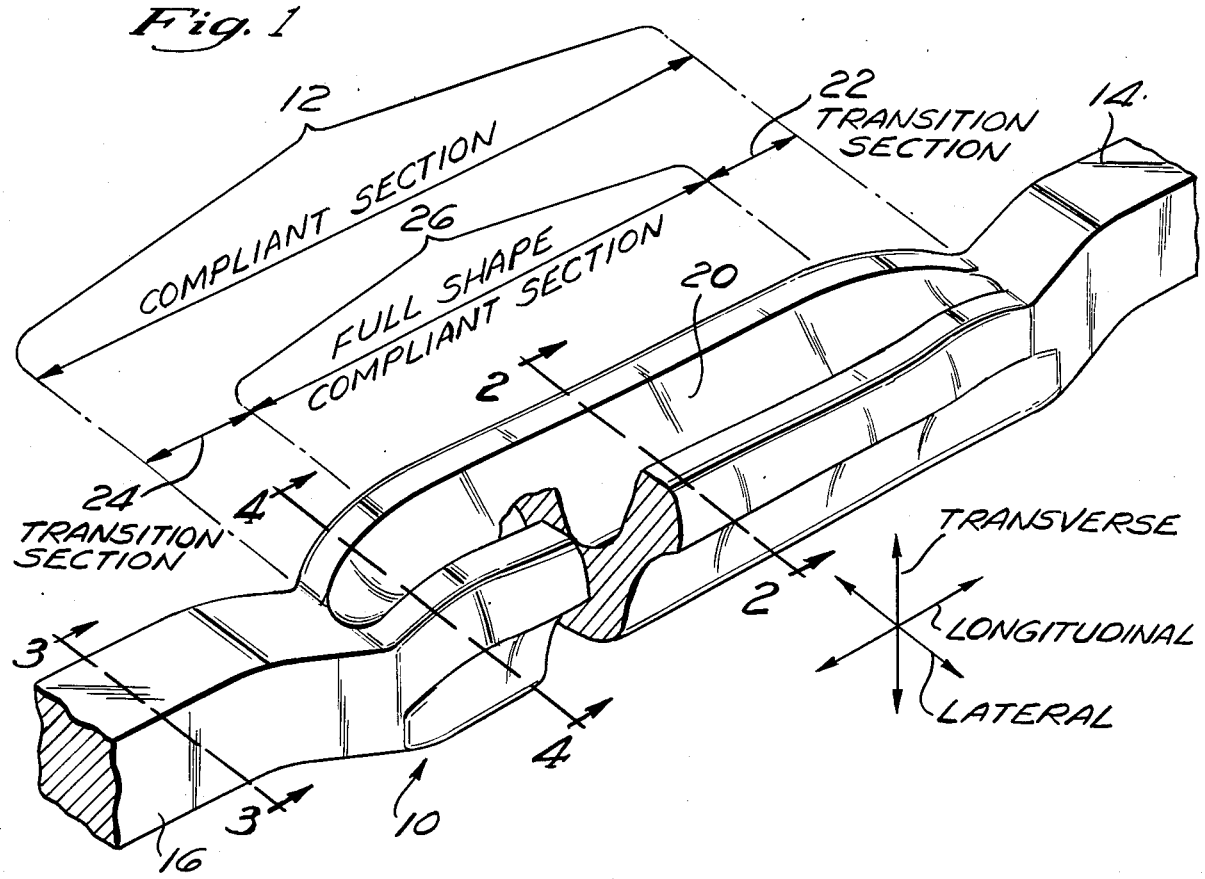
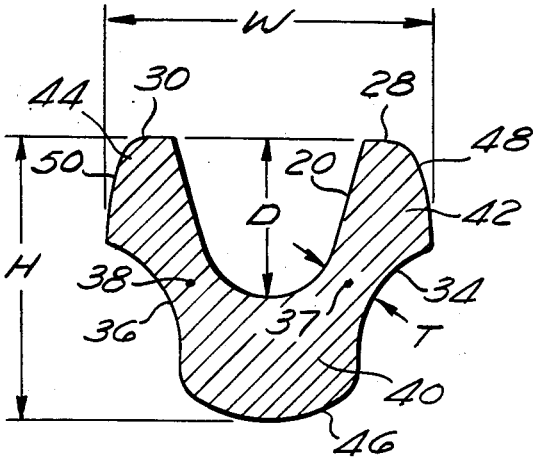
Fig. 2
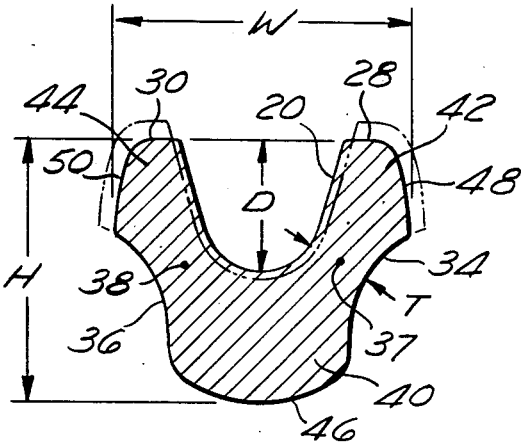
Fig. 4
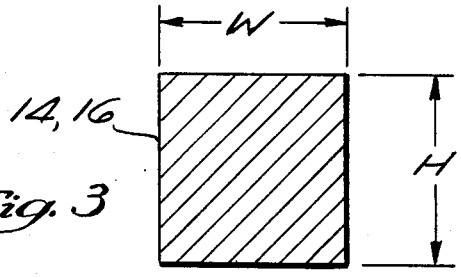
Fig. 3

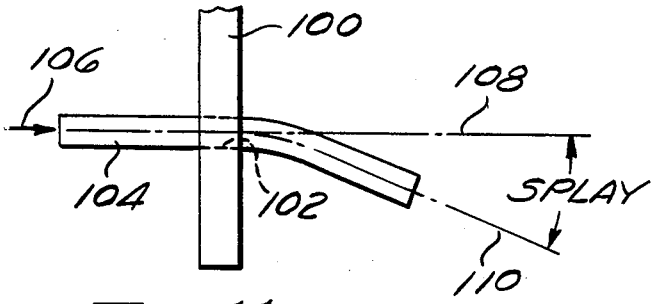
Fig. 11
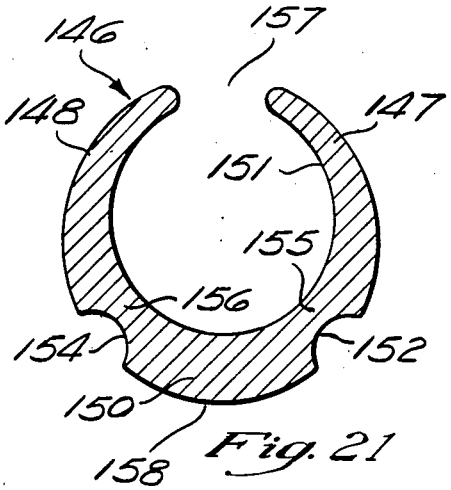
Fig. 21
Fig. 12a
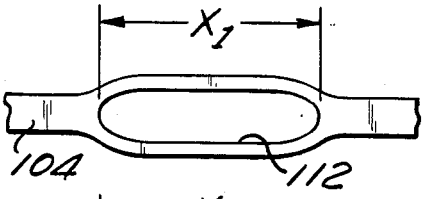
Fig. 13a
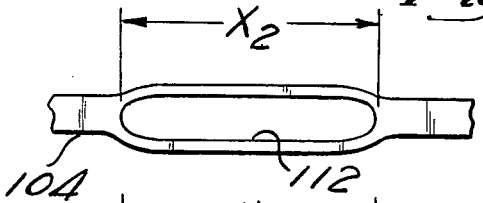
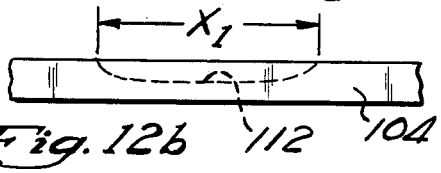
Fig. 12b
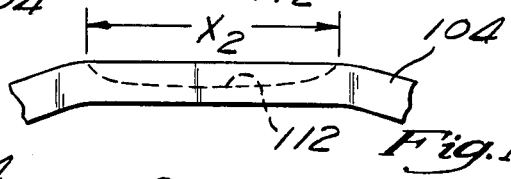
Fig. 13b
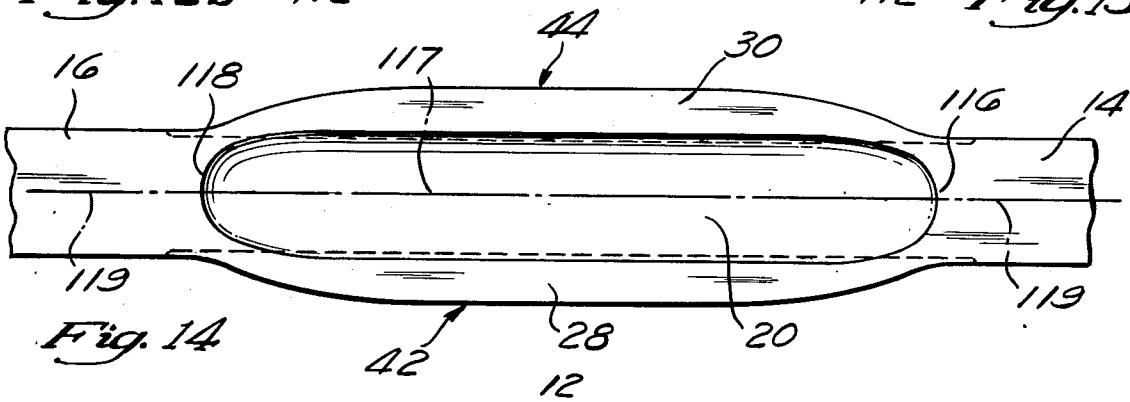
Fig. 14
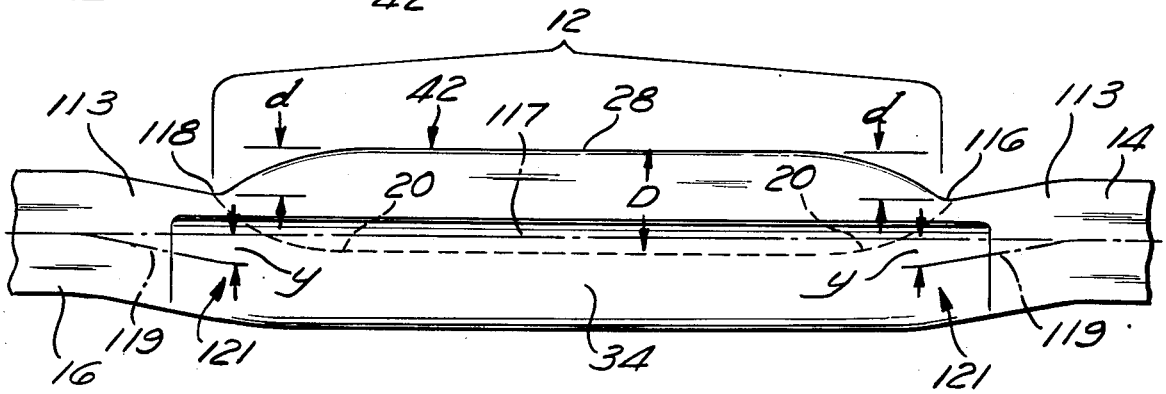
Fig. 15

COMPLIANT PRESS-FIT ELECTRICAL CONTACT

BACKGROUND

The present invention relates to electrical contacts, and particularly to electrical contacts having a compliant section for press-fitting into, e.g., round, plated through holes in printed circuit boards.

Compliant press-fit electrical contacts are advantageous for printed circuit board applications, since they make solderless, yet electrically sound, connections. One major problem with these contacts is that the compliant section must adapt to a wide variation in hole sizes, since it is difficult to manufacture printed circuit board holes which have extremely tight tolerances. For example, the industry tolerance standard for a 0.040 inch diameter finished hole size is ±0.003 inch, yielding a hole size range from 0.037 diameter to 0.043 diameter. After assembly into any hole within the tolerance range, the contact must withstand an axial load (i.e., withdrawal force) of ten pounds without displacement.

While many prior art designs provide the required ten pound withdrawal (or push-out) force, most require very high assembly (push-in) forces, especially in the smaller 0.037 inch diameter holes. This increase in assembly forces for the smaller holes can become quite significant when, e.g., 100 or more contacts are assembled at one time. Furthermore, some contacts tend to damage the hole and adjacent substrate during assembly, thereby rendering it unsatisfactory for installation of a replacement contact.

Two types of prior art compliant press-fit contacts are commonly available, namely the crescent type and the split beam type. The crescent type is structurally similar to the well known roll-pin used in many mechanical design applications in that it is substantially cylindrical in shape with a longitudinal opening of sufficient width to permit a predetermined reduction in its apparent diameter when laterally constricted. This crescent type contact has a generally uniform C-shaped cross section, and has smooth, continuous inner and outer surfaces. As the contact is pressed into a hole, its arms are deflected inwardly in a spring-like manner to provide the necessary interference fit. Due to the uniformity of cross section, deformation occurs throughout most of the cross sectional area of the contact during insertion, and therefore, whether such deformation is plastic or elastic or a combination thereof, the force required for additional deflection, when the contact is pressed into progressively smaller holes, increases at a relatively high, generally constant rate. Thus, as with many prior art contacts, this type of contact typically requires a substantially larger push-in force for the smaller 0.037 inch diameter hole than for the larger 0.043 inch diameter hole.

The split beam type contact is similar in structure to the eye portion of a needle. As the contact is pressed into a hole, the split beams deflect towards each other to close the "eye" therebetween. This contact is fundamentally different from the crescent type contact in that it collapses in a single plane passing longitudinally through the split beams. The crescent type contact, on the other hand, does not collapse in a single plane, but instead along the circumference of the contact. That is, when viewed cross sectionally, the crescent shaped arms slide circumferentially along the inner peripheral surface of the hole during closure, in contrast to the split beams which remain essentially stationary with respect to the inner peripheral surface of the hole during closure, and close without such circumferential sliding. Accordingly, contacts such as the split beam type contact will be referred to as "planar collapsible," while contacts, such as the crescent type contact will be referred to as "circumferentially collapsible."

Another problem with prior art compliant sections is that they are typically difficult to manufacture. The split beam design typically requires fragile, delicate punches, while the crescent shape design usually involves rolling operations or complex multi-station rounding operations. Such manufacturing problems make miniaturization of the prior art contacts difficult.

SUMMARY OF THE INVENTION

The present invention alleviates these and other problems of the prior art by providing a compliant press-fit electrical contact having a unique configuration, which reduces the push-in force differential between large and small holes within the hole tolerance range. In the disclosed embodiment, the contact is circumferentially collapsible, and, viewed cross sectionally, includes a base portion, with a pair of arm portions projecting therefrom to form a generally Y-shaped cross section.

The contact of the present invention includes a notched or grooved relief area of reduced cross sectional thickness which provides a stress concentration. The term "stress concentration", as used herein, is defined as an area which develops localized concentrated stresses when the contact is pressed into a hole to cause the contact to preferentially deform at that area. Such stress concentration provides a controlled, limited region of localized plastic flow, and thus, forms a plastic-elastic hinge. When the contact is inserted into a plated through hole in a printed circuit board, the hinge elastically deforms until a predetermined push-in force is reached, at which time a controlled plastic flow begins in a concentrated area. Once a region becomes plastic, that region requires little or no additional force for further deformation. Thus, by utilizing the stress concentration to limit the potential growth of plastic deformation and thereby concentrate the plastic deformation at a specific localized area, the increase in force required for additional deflection is reduced. In the embodiment described, the relief area is configured to yield plastic flow at or about the maximum hole size dimension, so that the smaller hole sizes in the tolerance range may be accommodated with relatively small additional push-in forces. The required minimum pull-out force (e.g. 10 pounds) is maintained for the entire range of hole sizes, since elastic energy remains stored in the hinge even after plastic flow begins. Thus, the present invention decreases the push-in force differential for the hole tolerance range, while maintaining the pull-out force above the required minimum.

The maximum insertion or push-in forces are a function of the work required to inwardly deflect the arms when pressing the contact into the hole. A major portion of such deflection occurs at the transition portion of the compliant section, i.e. the tapered portion which integrally connects the main body or full-shaped compliant section to the interconnect or tail portion. Accordingly, it is particularly important that the relief areas which form the plastic-elastic hinge extend into the transition sections, to reduce resistance to initial closure of the contact.

The contact of present invention is manufactured in accordance with a novel method which, advantageously, involves only four basic steps, and utilizes strong, simple tooling. The first step is to punch a series of spaced, parallel relief slots in a sheet metal strip. Next, the sheet metal material between adjacent relief slots is coined. Such coining forms a longitudinal trough in the sheet metal material and causes a portion of the sheet metal material to flow into each of the relief slots to form the arm portions of the contact. The material which was coined into the relief slots is substantially uniform in cross section throughout the length of the longitudinal trough. In an additional step, the coined material in the relief slots is punched to trim cut the arm portions of the contact to their finished size, and thus, provide the full-shape compliant section and the two transition sections. During this punching step, the tail portions may be simultaneously cut to form e.g. square wire wrapped posts. The trim cut arm portions are tapered through the transition section, however, the arm portions are substantially uniform through the full-shape compliant section. In a subsequent coining operation, the relief areas of the arm portions are thinned to yield the desired stress concentration, and sharp edges on the outside surfaces of the contact are rounded as necessary to prevent skiving of the hole during insertion. If desired, the manufacturing process may be modified to incorporate an additional forming step, in which the transition sections are preclosed somewhat to further reduce insertion forces on initial hole entry.

Thus, the manufacturing method of the present invention is quite simple, and avoids the delicate punches, rolling operations or complex multi-station rounding operations typical of the prior art. The simplicity of this method not only reduces manufacturing costs, but permits the contact of the present invention to be easily miniaturized. The miniaturization of interconnection systems lends itself to higher density component packaging, which is an increasingly important requirement in the electronics industry.

DESCRIPTION OF THE DRAWINGS

These and other advantages of the present invention are best understood through reference to the drawings in which:

FIG. 1 is a perspective view, partially in section, of the compliant contact of the present invention, showing the compliant section as comprising a full shape compliant section and a pair of tapered transition sections, each of which is between a respective tail section and the full shape compliant section;

FIG. 2 is a cross sectional view of the full shape compliant section, taken along the lines 2—2 of FIG. 1;

FIG. 3 is a cross sectional view of one of the tail sections, taken along the lines 3—3 of FIG. 1;

FIG. 4 is a cross sectional view of one of the transition sections, taken along the lines 4—4 of FIG. 1;

FIG. 11 is a schematic diagram of a contact being pressed into a hole and illustrating the center line of the contact bending relative to the center line of the hole so as to yield splay;

FIGS. 12 (*a*) and (*b*) are plan and elevation views, respectively, schematically illustrating the contact of FIG. 11, prior to insertion of the contact into the hole;

FIGS. 13 (*a*) and (*b*) are plan and elevation views, respectively, schematically illustrating the contact of FIGS. 12 (*a*) and (*b*) after being pressed into the hole, and showing the resulting elongation of the trough;

FIG. 14 is a plan view of the contact of the present invention, showing the longitudinal trough in the compliant section;

FIG. 15 is an elevation view of the contact of FIG. 14, showing the arm portions of the compliant section raised above the ends of the trough by a distance d to reduce or eliminate splay, and further showing a jog in the tail portions of the contact, to coaxially align the tail portions with the compliant section;

FIG. 21 is a cross sectional view of the compliant section of a C-shaped contact, showing longitudinal grooves extending the length of the compliant section to form areas of reduced cross sectional thickness to provide plastic-elastic hinges.

DETAILED DESCRIPTION OF THE PREFERRED EMBODIMENT

Figure 5:
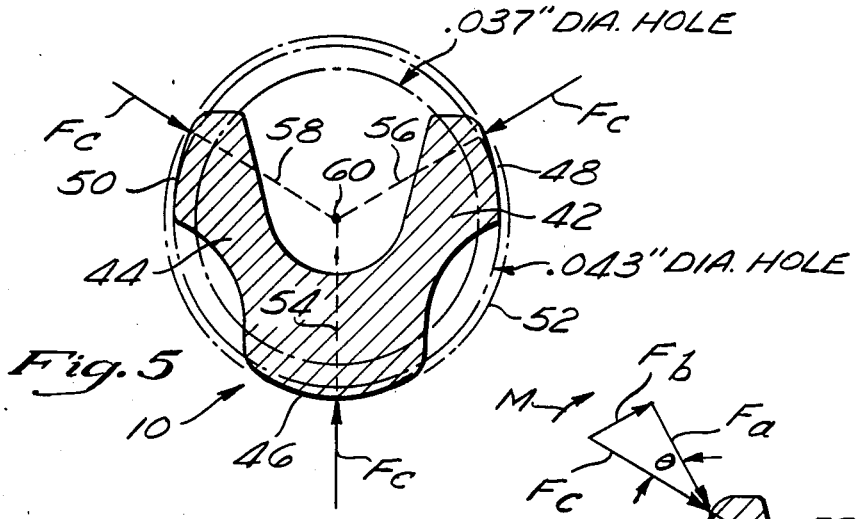
FIG. 5 is a cross sectional view of the full shape compliant section, showing the hole-engaging surfaces as lying substantially along a circle, and showing the maximum and minimum hole sizes for an exemplary hole size tolerance range.

In the preferred embodiment, shown in FIGS. 1 through 4, the contact 10 of the present invention comprises a compliant section 12 interposed between an interconnect or tail section 14 and an interconnect or tail section 16. These sections 12,14,16, in the embodiment shown, are unitary and integrally formed from a single piece of metal, such as a copper alloy. It will be understood that the interconnect or tail sections 14,16 may vary in structure depending upon the application, and may comprise e.g. a variety of interconnect members, such as pin contacts, wire-wrapped tails, socket contacts, or portions of socket contacts.

The compliant section 12 includes an elongate opening or trough 20, which, in FIGS. 1, 2 and 4, is disposed in an upward facing orientation. In the embodiment shown, the elongate opening 20 is an "open" trough, which as used herein, refers to a trough whose width decreases, or at least does not increase, as its depth increases. Stated another way, an "open" trough is a trough which is either progressively narrower or uniform in width from the top of the trough to the bottom, so that all surfaces of the trough are simultaneously visible.

For reference purposes, a three-dimensional coordinate system will be established in which longitudinal, lateral, and transverse are used to define three mutually orthogonal directions. As shown in FIG. 1, the longitudinal direction is along the length of the contact, along the tail sections 14,16 and compliant section 12. The transverse direction extends upward and downward, while the lateral direction extends from side to side.

The compliant section 12, which extends longitudinally from one end of the trough 20 to the other, includes a transition section 22, adjacent the tail section 14, and a second transition section 24, adjacent the tail section 16. Between the transition sections 22,24, and adjacent thereto, is a full-shaped compliant section 26. This full-shaped compliant section 26 is uniform in cross section. The transition sections 22,24, on the other hand, have tapered cross sections, at least in terms of their external dimensions, to provide a smooth, gradual transition between the full-shaped compliant section 26 and the tail sections 14,16.

As shown in FIG. 2, the full-shaped compliant section 26 has a maximum transverse dimension or height H, and a maximum lateral dimension or width W. The depth D of the trough 20 is measured from the upper edge surfaces 28,30, adjacent the trough 20. For the preferred embodiment, which is adapted to be press-fit in a nominal 0.040 inch hole with a ±0.003 inch tolerance, the dimensions H, W, and D may be 0.036 inch, 0.043 inch, and 0.020 inch, respectively. The tail sections 14,16 may comprise e.g. a 0.025 inch square post, and thus, the dimensions H and W of the tail sections 14,16, shown in FIG. 3, may each be 0.025 inch. Since the trough 20 does not extend into the tail portions 14,16, the dimension D will be zero. The dimensions H and W gradually decrease through the transition sections 22, 24, as shown in FIG. 4, to provide a smooth, gradual, tapered transition between the tail sections 14,16 and the full-shaped compliant section 26. The dimension D, on the other hand, remains substantially the same in the transition sections 22, 24, as in the full-shaped compliant section 26, but then rapidly decreases towards zero as the trough 20 terminates. For comparison purposes, the cross sectional outline of the full-shaped compliant section of FIG. 2 is shown in phantom lines in FIG. 4.

As shown in FIGS. 2 and 4, the compliant section 12 (FIG. 1) includes a base portion 40 at the bottom of the upwardly facing trough 20, and a pair of arm portions 42,44, which form the sides of the trough 20. The arm portions 42,44 of the compliant section include a pair of relief areas 34,36, respectively, which comprise respective longitudinal grooves extending the full length of the compliant section 12, including at least a portion of the transition sections 22,24. As will be discussed in detail below, these relief grooves 34,36 cause the arms 42,44 to preferentially bend along longitudinal axes or hinge lines 37,38, respectively, in response to inward deflection of the arms 42,44.

In the embodiment shown, the relief grooves form concave surfaces and are disposed on the outside surface of the contact 10. Between the relief grooves 34,36, at the base portion 40, a convex, downwardly, transversely facing hole-engaging surface 46 is provided. Similarly, the ends of the arm portions 42,44 include respective convex laterally, outwardly facing hole engaging surfaces 48,50, respectively. The surface 48 extends between the upper edge surface 28 and the relief groove 34, while the surface 50 extends between the upper edge surface 30 and the relief groove 36. Accordingly, the relief areas 34, 36 are disposed between the base portion 40 and the ends of the arm portions 42, 44, respectively.

Thus, the contact of the preferred embodiment may be viewed as an elongate member, with a longitudinal transversely upwardly facing trough and a pair of laterally outwardly facing longitudinal grooves on respective sides of the trough 20. The cross section of the compliant section 12 is symmetrical about a longitudinally transverse plane (i.e. vertical plane) passing through the bottom of the trough 20 so as to give the compliant section 12 a generally Y-shaped cross sectional appearance.

As shown in FIG. 2 the relief grooves 34,36 provide reduced cross sectional areas in the arm portions 42,44, respectively, at the location indicated by the dimension T. In the embodiment shown, the dimension T, which represents the minimum thickness of the arms 42,44, is 0.007 inch. Further, the concave surfaces of the grooves 34,36 follow a 0.014 inch radius.

The radius of curvature of the grooves 34,36 is substantially the same for the transition sections 22,24 as for the full-shaped compliant section 26, as shown in FIG. 4. At the ends of the trough 20, in the portions of the transition sections 22,24 which are adjacent to the tail portions 14,16 the dimension T increases as the trough 20 terminates, however, this dimension T is the same as for the full-shaped compliant section 26 in the portions of the transition sections 22,24 which are adjacent to the full-shaped compliant section 26, thereby reducing resistance to inward deflection of the arms 42,44 in the transition sections 22,24.

The surfaces 46,48,50 lie substantially upon a circle 52, which is larger than the maximum size hole (0.043 in this case), as shown in FIG. 5. Thus, the surfaces 46,48 and 50 form segments of a segmented circle. Additionally, the edges adjacent to the contact surfaces 46,48, and 50 are rounded as necessary to eliminate sharp corners. This configuration for the surfaces 46, 48, and 50 reduces damage to the hole during insertion of the contact 10.

When the contact 10 is pressed into a plated through hole within the tolerance range (i.e. 0.037 to 0.043 inch diameter in this exemplary case), the compliant section 12 will engage the inner surfaces of the hole at the surfaces 46,48, and 50. Such engagement generates contact forces $F_c$ at each of the three surfaces 46,48,50, which are directed along respective longitudinal planes 54, 56, 58, passing through the center 60 of the hole. These forces $F_c$ bear radially inwardly on the contact 10, to deform the contact 10 to fit within the periphery of the hole.

Figure 6:
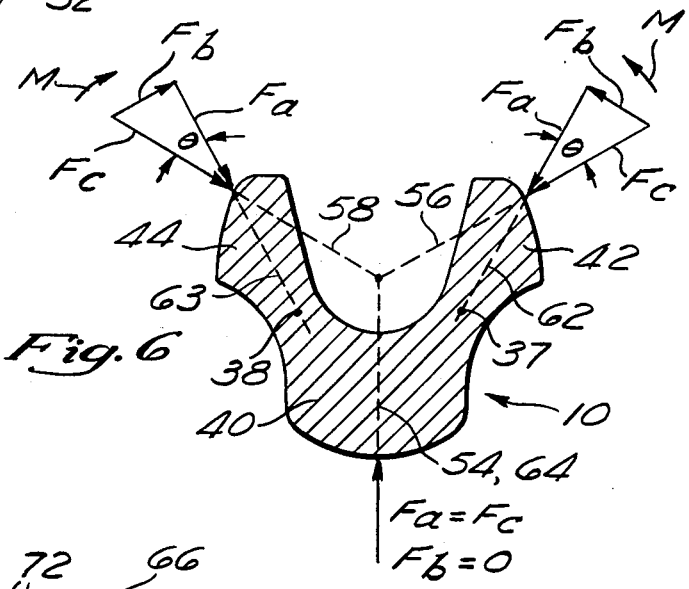
FIG. 6 is a cross sectional view of the full shape compliant section, showing the contact force between the hole and the compliant section resolved into forces which create a bending moment on the arms of the contact.

As shown cross sectionally in FIG. 6, the arms 42, 44 of the contact 10 of the present invention, may be viewed as having respective longitudinal planes 62, 63, which longitudinally bisect the arms 42, 44, respectively. Similarly, the base 40 may be viewed as having a longitudinal plane 64, which longitudinally bisects the base 40. The plane 64 passes through the center 60 of the hole, and thus, is coincident with the plane 54 (FIG. 5). The planes 62, 63, on the other hand, are displaced from the planes 56, 58 by an angle $\theta$ and thus do not pass through the center 60, but rather through the longitudinal axes 37, 38. Consequently, the contact forces $F_c$ on the arms 42, 44 may be resolved into two components, namely an axial component $F_a$ directed along the planes 62, 63 and a bending component $F_b$ which is perpendicular to the axial component $F_a$. The bending force component $F_b$ is equal to the contact force $F_c$ times sin $\theta$, while the axial force $F_a$ is equal to the contact force $F_c$ times cos $\theta$. Since the contact force $F_c$ at the base 40 is directed along the longitudinal plane 64 of the base 40, the axial force $F_a$ will equal the contact force $F_c$ and the bending force $F_b$ at the base 40 will be zero.

Figure 7:
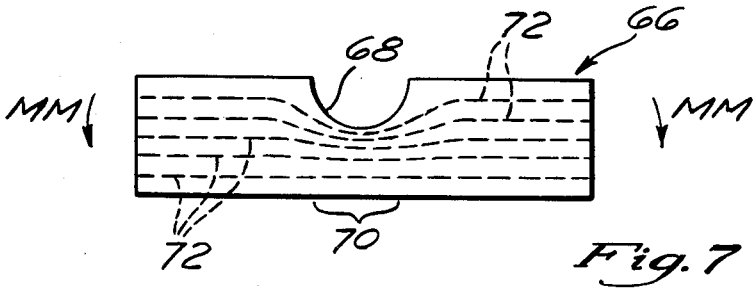
FIG. 7 is a schematic diagram of a beam having a notch therein, and showing the stress concentration caused by the notch when a bending moment is applied.
Figure 8:
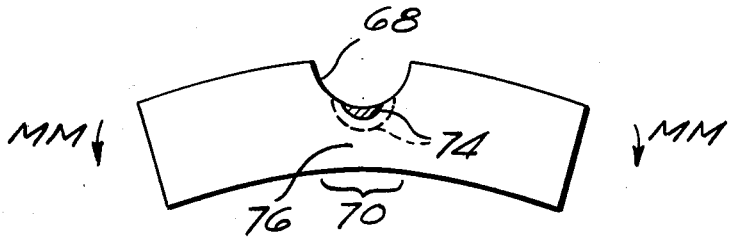
FIG. 8 is a schematic diagram of the notched beam of FIG. 7, illustrating that the stress concentration causes a plastic flow at the notch in response to the bending moment.

The bending forces $F_b$ on the arms 42, 44 result in a bending moment M which tends to deflect the arms 42, 44 towards each other. The behavior of the contact 10 in response to such bending moment may be more fully understood though a brief and somewhat simplified discussion of beam theory. For purposes of illustration, each of the arms 44,48 may be viewed as analogous to a beam 66 having a notch 68 therein, as shown in FIG. 7. Bending moments MM on the beam 66 place the notched or top side of the beam in tension and the unnotched or bottom side of the beam in compression. The stresses will be more or less uniformly distributed through the unnotched side of the beam 66, but will be concentrated on the notched side of the beam at the portion 70 immediately beneath the notch 68. Such concentrated stresses in the beam portion 70 are due to the fact that the stresses are distributed within a smaller area, as illustrated schematically by lines 72, each of which represents a line of equal stres. Note that these stress lines are much more highly concentrated at the beam portion 70, particularly in the area adjacent to the notch 68, than they are in the remainder of the beam 66. In general, the stresses will be highest at the surface at the bottom of the notch, and will decrease towards the neutral axis (not shown). As the bending moments MM are applied, the initial deformation of the beam 66 will be elastic. However, as the stresses increase at the portion 70, a region of plastic flow or deformation 74 will be created at the bottom of the notch 68 in the beam portion 70 as shown in FIG. 8, causing the beam 66 to preferentially deform at the beam portion 70 adjacent to notch 68. Thus, after plastic deformation begins, the beam portion 70 will have a plastic region 74 and an elastic region 76. In addition, some plastic flow (not shown) may occur on the bottom side of the beam 66, which is in compression. As the bending moments MM increase, the plastic region 74 will extend further into the beam portion 70, thereby decreasing the elastic region 76. As the plastic region grows. the required increase in bending moment for further deflection lessens. If the bending moment is increased so as to cause the plastic flow to extend completely through the beam portion 70, the beam will continuously yield without a further increase in the bending moment, causing the beam to ultimately collapse and bend back upon itself.

Figure 9:
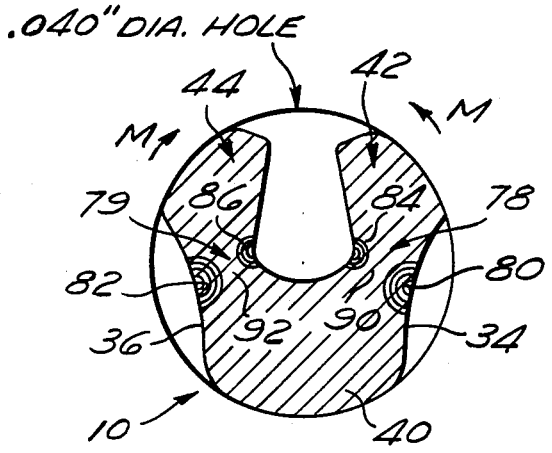
FIG. 9 is a cross sectional view of the contact of the present invention after it has been pressed into a nominal sizes hole, illustrating regions of plastic flow at the relief area of reduced cross sectional thickness formed by the relief grooves, and showing elastic regions between the plastic regions for storing energy expended in deflecting the arms inwardly, towards each other.

The principles discussed above in reference to the beam 66 may be applied to explain the behavior of the contact of the present invention as it is pressed into e.g. a 0.040 inch hole, as shown in FIG. 9. Like the notch 68 (FIGS. 7 and 8), the longitudinal grooves 34,36 provide respective areas 78, 79 of reduced cross sectional thickness, and thus, create stress concentrations which cause the arms, 42,44 to preferentially bend at the areas 78,79 in response to their respective bending moments M, created by the contact forces $F_c$ (FIG. 6). As the contact 10 is pressed into a hole, these stress concentrations at the areas 78,79 cause controlled, localized regions of plastic flow 80,82, respectively, to occur at the areas 78,79, respectively, adjacent to the longitudinal grooves 34,36, respectively. In addition, there may be an additional region of plastic flow in each of the areas 78,79 such as the regions 84,86, which radiate from the inside surface of the trough 20 towards the plastic regions 80,82 respectively. In the embodiment shown, it is believed that because of the geometry of the arms 42, 44 any plastic flow at the regions 84,86 will generally be less than at the regions 80,82, and that plastic flow in the areas 78,79 will initially begin at the regions 80,82.

Between the plastic region 80 and the plastic region 84 is an elastic region 90. Similarly, between the plastic region 84 and the plastic region 86 is an elastic region 92. The size of these elastic regions 90,92 is, of course, determined by the penetration of the plastic regions, 80,84 and 82,86 from the surface of the contact 10. The elastic regions 90, 92 store energy expended in deflecting the arms 42,44 inwardly, towards each other, and thus, provide an outward force against the edges of the hole to resist the bending moment M. Those skilled in the art will recognize that some elastic energy is also stored in the plastic regions 80,84 and 82,86, and at or around the boundary between the plastic regions, 80, 84, 82, 86 and adjacent areas. The total elastic energy stored in or around these regions 80, 82, 84, 86, 90, 92 provides outward interference forces by the arms 42,44 and base 40 against the inner surface of the hole to maintain the required 10 pound withdrawal or "pull-out" force. If the plastic regions 80,84 and 82,86 are permitted to flow into each other, the elastic energy stored in or around these plastic regions may still be sufficient to provide the necessary interference fit, providing the stresses in areas 78, 79 do not exceed the ultimate tensile strength of the material, whereby failure would result. Accordingly, the areas 78,79 of reduced cross sectional thickness, in the embodiment shown, are sized and configured so as to avoid metal failure and maintain sufficient stored energy in the areas, 78,79 throughout the desired hole tolerance range. The reduced cross sectional areas 78,79 thus form "plastic-elastic hinges" at the longitudinal axes or hinge lines 37,38 (FIGS. 2, 4 and 6) respectively. As used herein, the term "plastic-elastic hinge" defines an area of preferential bending having a region of localized plastic deformation for one or more holes sizes within the hole tolerance range. Those skilled in the art will understand that such plastic-elastic hinges may be formed through a variety of geometries, e.g. by varying the depth and/or width of the grooves 34, 36 to yield the desired stress. concentration.

Figure 10:
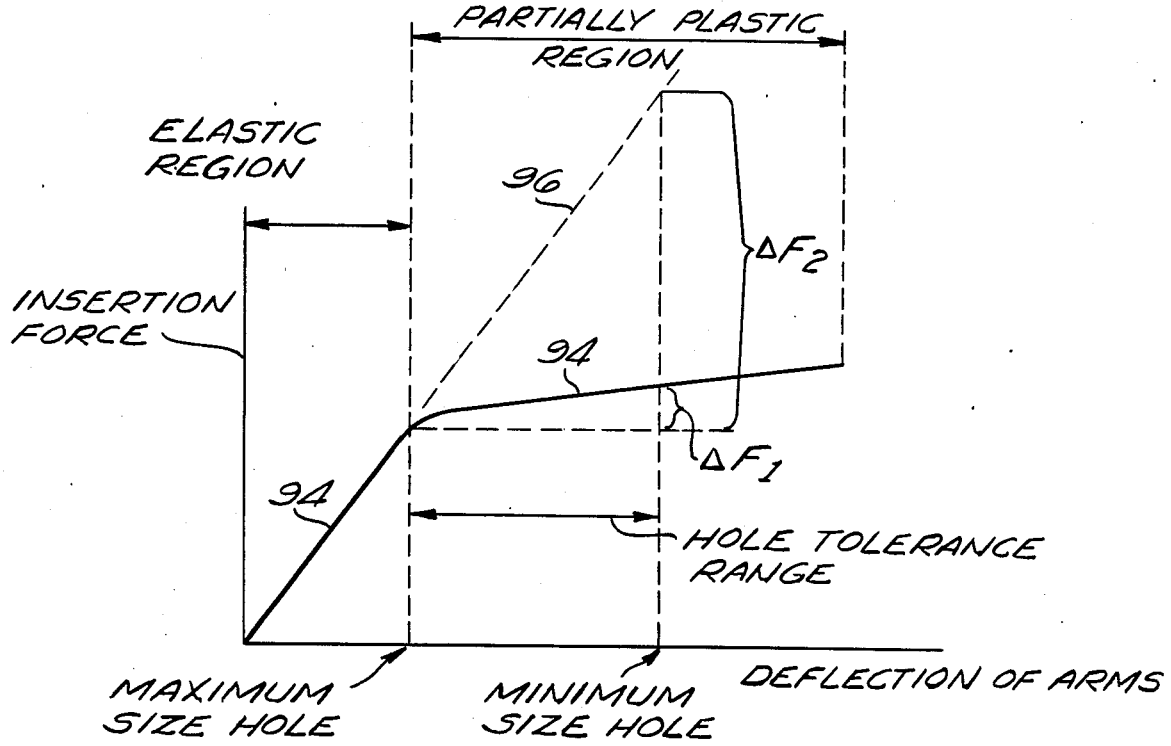
FIG. 10 is a drawing of insertion force versus the deflection of the arms, showing the stress-strain relationship as the contact of the present invention is pressed into holes within the hole tolerance range, and illustrating the reduced insertion force differential for the hole tolerance range, due to the plastic-elastic regions of FIG. 9.

As illustrated by an insertion force vs. arm deflection curve 94 in FIG. 10, plastic flow in the reduced cross sectional areas 78,79 should preferably begin when, or before, the amount of deflection of the arms 42,44 corresponds to the maximum hole size within the tolerance range. In the embodiment shown, when the contact 10 is inserted into a maximum size hole, (e.g. 0.043 inch), the arms will deflect elastically through the portion of the curve 94 labeled "elastic region". However, when the contact 10 is pressed into smaller hole sizes within the tolerance range, (e.g. a 0.037 inch hole) the arms 42,44 will initially deflect in accordance with the elastic region of the curve 94, and subsequently deflect in accordance with the portion of the curve 94 labeled "partially plastic region". Note that, for the embodiment shown, the entire hole tolerance range is within the partially plastic region of the curve 94. Also note that the curve 94 tends to be substantially less steep in the partially plastic region than in the elastic region. Thus, once the arms are deflected by an amount sufficient to enter the partially plastic region, it requires little additional force to further deflect the arms. The difference in insertion force required to press the contact into a minimum size hole is illustrated as being $\Delta F_1$ greater than that required to press the same contact into a maximum size hole. Thus, it requires an additional force $\Delta F_1$ to deflect the arms by an amount corresponding to the hole tolerance range. $\Delta F_1$ is relatively small because the reduced cross sectional areas 78,79 limit or concentrate the area of plastic deformation as compared to a contact without such reduced cross sectional areas. If the contact did not have the areas 78, 79 of reduced cross sectional thickness, so that the plastic deformation were not concentrated, the deformation would occur over a much larger area, and substantially greater forces would be required to deflect the arms during insertion of the contact. In such case, the behavior of the contact would be more elastic, approaching the ideally elastic relationship illustrated by the line 96. In the ideally elastic case, a force, e.g. $\Delta F_2$, which is huge compared to $\Delta F_1$, would be required to deflect the arms by an amount corresponding to the hole tolerance range. Thus, the contact of the present invention substantially decreases the insertion force differential through the hole tolerance range.

Although the insertion force differential for holes within the hole tolerance range is decreased, it is emphasized that the elastic energy stored in the areas 78,79 (FIG. 9) is not reduced, but is maintained. Elastic energy is stored at a first rate through the "elastic region" of the curve 94, and at a second rate, substantially less than the first rate, through the "partially plastic region" of the curve 94. Therefore, the withdrawal or "push-out" force will be at least as great for smaller holes within the tolerance range as for large holes in that range. Accordingly, the present invention reduces insertion force differential, while maintaining the required minimum withdrawal force for all hole sizes within the tolerance range.

The contact 10 of the present invention is also configured to reduce splay. As is well known to those skilled in the art, the term splay refers to the tendency of a compliant pin to bend when it is pressed into a hole. For example, FIG. 11 shows a printed circuit board 100 having a hole 102 into which a compliant pin 104 is pressed in the direction indicated by the arrow 106. The amount of splay may be determined by measuring the angle between the center line 108 of the hole and the center line 110 of the pin.

FIGS. 12 (*a*) and (*b*) show the compliant contact 104 of FIG. 11 as including a trough 112, which has a length $X_1$. When the contact 104 is pressed into the hole 102 (FIG. 11), the inward radial forces on the contact 104 cause the top edges of the trough 112 to close, so that it narrows and elongates to a length $X_2$, as shown in FIGS. 13 (*a*) and (*b*), which length is greater than $X_1$. Therefore, such elongation of the trough 112 will be greater at its top, than at its bottom, so that one side of the contact lengthens relative to the other. It is believed that this lengthening is a contributing factor, if not a primary factor, in causing splay.

The present invention reduces or eliminates splay by extending the arm portions 42,44 substantially above the ends of the trough 20, so that the trough 20 undergoes little or no lengthening of the type illustrated in FIGS. 12 and 13 in response to inward deflection of the arms 42,44. This feature of the present invention may be more fully understood through reference to FIGS. 14 and 15 which show plan and elevation views of the contact of FIGS. 1 through 4. Referring particularly to FIG. 15, it may be seen that the upper edge surfaces 28,30 of the arms 42,44, respectively, project upwardly from the ends 116, 118 of the trough 20 by a distance d. In the context of this feature of the present invention, the term "ends of the trough" refers to the surfaces 116,118 which are immediately adjacent to the ends of the trough 20, at the juncture of the compliant section with the tail portions 14,16. By way of specific example, the dimension d may be about 0.009, while the depth D of the trough 20 may be about 0.020 inch. Such upward projection or displacement of the arms 42,44 permits them to deflect inwardly, toward each other, without substantially lengthening the trough 20, thereby reducing or eliminating splay.

As shown in FIG. 15, the upward displacement of the arms 42,44 relative to the ends 116,118 of the trough 20 causes a disalignment or displacement of the central axis 117 of the compliant section 12 with the central axes 119 of the tail portions 14, 16 at their respective junctures indicated generally by the reference numerals 121. Such disalignment or displacement of the axes 117,119 is indicated by the dimension y in FIG. 15. As used herein, the term central axis of the compliant section is defined as a longitudinal axis through the compliant section 12 which is coincident with the center of a nominal size hole (0.040 inch in the exemplary case) when the contact 10 is seated therein. The central axis of the tail sections, on the other hand, is defined as a longitudinal axis passing through the centerline of the tail sections 14, 16. A jog 113 may then be formed in the tail sections 14,16 at a point removed from the juncture 121, to displace the tail sections toward the upper edge surfaces 28,30 of the arms 42,44 to provide coaxial realignment between the central axes 119 of the tail portions 14,16 and the central axis 117 of the compliant section 12.

Figure 16:
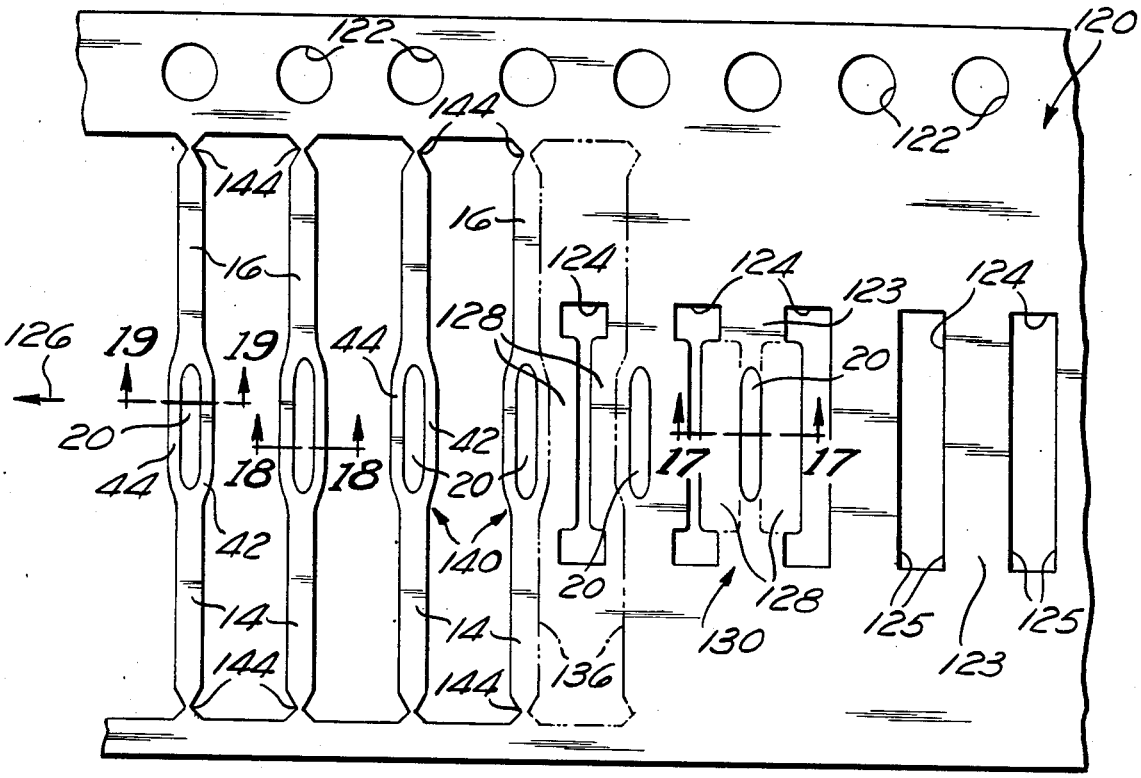
FIG. 16 is a plan view of a sheet metal strip, schematically showing the sequential steps in manufacturing the contact of the present invention.

Referring to FIG. 16, the contact of the present invention may be manufacured from a strip of sheet metal 120 exclusively by punching and coining in a multi-station die operation. The sheet metal strip 120 includes a series of spaced apertures or pilot holes 122 along one edge thereof for aligning the strip 120 in the die. The first step in manufacturing the contact 10 is to punch spaced, parallel relief slots 124 in the strip 120 to provide elongate strips of materials 123 between adjacent relief slots 124. In the embodiment shown, the longitudinal edges 125 of the elongate strips 123 are perpendicular to the direction of travel of the sheet metal 120, which is indicated by the arrow 126.

Figure 17:
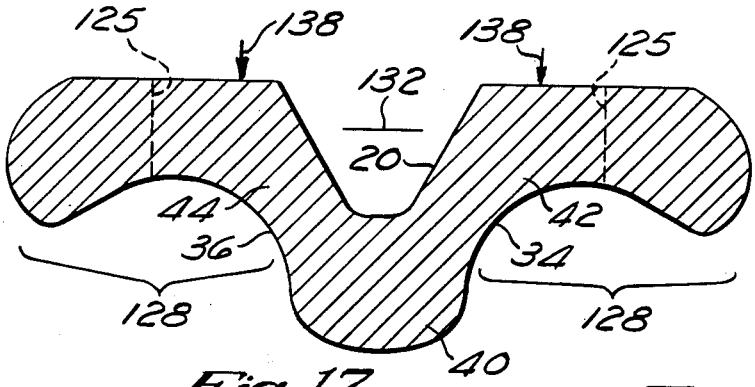
FIG. 17 is a cross sectional view of the compliant section, taken along the line 17—17 of FIG. 16 showing the longitudinal trough, arm portions, relief grooves, and base portion as being formed in a single coining operation.

In a subsequent step of the manufacturing process, the sheet metal material 128 which is adjacent to each of the longitudinal edges 125 of the elongate strips 123 is coined, causing a portion of the coined material 128 to flow into the relief slots 124, as indicated generally at 130. During this step, the area between the coined areas 128 is simultaneously coined from the opposite side to form the longitudinal trough 20. The coining operations of this step may be more fully understood through reference to the cross sectional view of FIG. 17, which shows the coined areas 128 and trough 20 of FIG. 16 in more detail. As shown in FIG. 17, the coining operation results in a substantially Y-shaped cross section, similar to that of FIG. 2, which includes the base portion 40, arm portions 42,44, relief areas 34,36 and trough 20. The upper portions of coined areas 128 are upwardly displaced above the surfaces 116,118 at ends of the trough 20, represented by the line 132, so that the areas 42, 44 also project above the surfaces 116, 118 at the ends of trough 20 a we discussed in reference to FIGS. 14 and 15.

Figure 18:
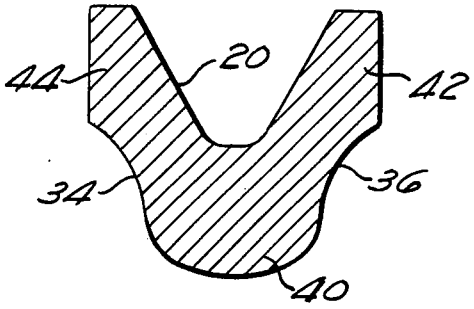
FIG. 18 is a cross sectional view of the compliant section, taken along the lines 18—18 of FIG. 16, after trim cut punching to size the arms to their substantially finished dimensions.

A further step of the manufacturing process involves trim cut punching along the phantom lines 136 of FIG. 16, at the location indicated by the arrows 138 in FIG. 17, to remove most of the coined area 128, so as to size the arm portions 42,44 of the contact substantially to their finished dimensions, as shown in FIG. 18, and as indicated substantially at 140 in FIG. 16. The trim cutting is accomplished such that the arm portions 42,44 are tapered through the transition sections 22,24 (FIG. 1) to provide a smooth, gradual transition between the full-shape compliant section 26 (FIG. 1) and the tail sections 14,16. However, the arm portions 42,44 are cut so that they are substantially uniform in cross-section throughout the full-shape compliant section 26 (FIG. 1). During this trim cut punching step, the tail portions 14, 16 may be simultaneously cut to form, e.g., square wire wrap posts. Notches 144 are provided at the end of the tail portions 14,16, to facilitate separation of the contact 10 from the remainder of the sheet metal strip 120. Thus, the entire outer contour of the contact 10, including the transition section 12 (FIG. 1) and the tail sections 14,16, may be manufactured during this trim cut punching step.

Figure 19:
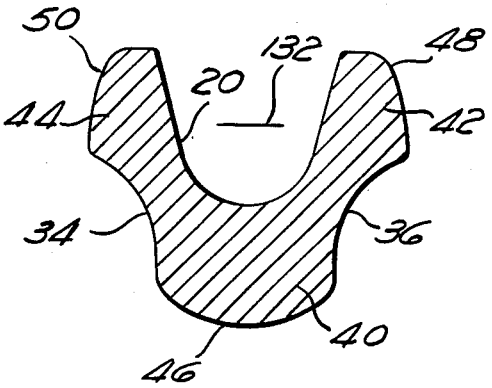
FIG. 19 is a cross sectional view of the compliant section, taken along the lines 19—19 of FIG. 16, showing the relief areas after they have been thinned by coining, and further showing the hole engaging surfaces as being rounded to lie substantially upon the circle shown in FIG. 5.

Although the cross section of FIG. 18 is usable as a compliant contact, it is preferable to perform another coining step to refine the contour and cross sectional dimensions of the compliant section for improved performance. In this coining operation, the arm portions 42,44 are thinned to the dimension T (FIG. 2) to yield the desired stress concentration in the relief areas 34,36, as shown in FIG. 19. In addition, the surfaces 46,48 and 50 are rounded and contoured to lie substantially along the circle 58 (FIG. 5) to eliminate sharp corners where necessary to generally conform the periphery of the contact to fit within a hole, thereby reducing the risk of skiving or other hole damage during insertion. Further, in the finished contact of FIG. 19, the arms are raised from the surfaces 116, 118 (FIGS. 14 and 15) represented by the line 132, by the same distance d as was shown in FIGS. 14 and 15.

If desired, an additional forming step may be incorporated into the manufacturing process. During this step the transition sections may be pre-closed slightly, by forcing the arm portions 42, 44 in the transition sections towards each other. to reduce insertion forces upon initial entry of the contact into the hole.

Figure 20:
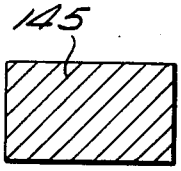
FIG. 20 is a cross sectional view of a metal wire which provides an elongate metal strip for manufacturing the contact of the present invention.

Those skilled in the art will recognize that instead of manufacturing the contact 10 from the strip of sheet metal 120, the contact 10 may be alternatively manufactured from a length of metal wire 145, having e.g. a rectangular cross section, as shown in FIG. 20. In such case, the contacts 10 are manufactured in serial fashion, along the length of the wire, with the central axis 117 (FIG. 15) of the contact along the length of the wire. In effect, the wire provides a series of the elongate strips 123 (FIG. 16), which are arranged in an integrally connected end-to-end orientation, rather than the spaced, parallel, side-by-side orientation of FIG. 16. The manufacturing steps are identical to those described above for the strip 120, except that there is no need to punch the relief slots 124 since the coined areas 128 will simply extend beyond the sides of the wire.

Thus, the manufacturing methods of the present invention involves simple coining and cutting operations, with strong, simple tooling, which makes the contact 10 easy to manufacture and easy to miniaturize. It will be understood by those skilled in the art that the manufacturing process described herein may be inverted, in which case references to upper and lower surfaces would likewise therefore be reversed.

While the Y-shaped cross sectional design, described above, is presently preferred, those skilled in the art will recognize that the inventive concepts disclosed herein are not limited to a contact having a Y-shaped cross section, but may also be utilized with other cross sectional designs. For example, referring to FIG. 21, there is shown a contact 146, having a C-shaped cross section which forms a tubular trough 151. The C-shaped contact 146 includes a pair of arm portions 147,148 projecting from a base portion 150. The arm portions 147,148 include respective longitudinal grooves 152,154 which provide relief areas 155,156 of reduced cross sectional thickness to form stress concentrations. When the contact 146 is inserted into a hole, the stress concentrations cause preferential bending at the relief grooves 152,154. Preferably, the grooves 152,154 are sized to provide plastic-elastic hinges, as discussed above in reference to FIGS. 7 to 9. Although two grooves 152,154 are shown in FIG. 21, a single groove, e.g. opposite the opening 157, at the location designated by the reference numeral 158, would also be functional. However, it is believed that two or more grooves will provide better conformance of the contact to the periphery of the hole than one groove. Further, while the grooves 152,154 are shown as being on the outside surface of the contact 146, it will be understood that they may also be formed on the inside surface of the contact 146. Regardless of whether the grooves 152,154 are on the inside or outside surface of the contact 146, it is believed to be preferable to locate each of the grooves on the portion of the contact 146 which is opposite the opening 157, i.e. the portion which is disposed at least 90°, but less than 270°, from the opening 157.

By utilizing relief grooves to from plastic-elastic hinges, the contact of the present invention satisfies the minimum withdrawal force requirement for all hole sizes within the hole tolerance range, while reducing the insertion force differential between the smallest and largest hole size within that tolerance range. Moreover, the circumferentially collapsible design of the present invention yields minimum hole degradation for all hole sizes within the range.

What is claimed is:

1. In a compliant electrical contact for press fitting into a hole, a compliant section which comprises:

a first arm portion having a surface at the end thereof for engaging the inner surface of said hole upon insertion of said contact into said hole;

a second arm portion having a surface at the end thereof for engaging the inner surface of said hole upon insertion of said contact into said hole;

a base portion, between said arm portions and adjacent thereto, said base portion having a surface for engaging the inner surface of said hole upon insertion of said contact into said hole;

a single, central longitudinal trough for accommodating closure of said contact, said arm portion and said base portion forming the interior surfaces of said trough; and first and second relief areas, formed in said first and second arm portions, respectively, and disposed between said base portion and the ends of said arm portions, respectively, said relief areas displaced from the central axis of said compliant section, and having a reduced cross-sectional thickness relative to (i) that of said base portion and (ii) that of the ends of said arm portions, respectively, the cross-sectional thickness of said relief areas selected to provide a stress concentration at said relief areas to cause said first and second arm portions to preferentially bend relative to said base portion such that said arm portions deflect inwardly towards the center of said compliant section about first and second longitudinal axes, respectively upon insertion of said contact into said hole, said first and second axes located at said first and second relief areas, respectively, whereby most of the bending of said arm portions occurs at said relief areas.

2. A compliant section, as defined by claim 1, wherein said compliant section comprises a full shaped compliant section and a tapered transition section, said relief areas extending from said full shaped compliant section into said tapered transition section, the cross-sectional thickness of said relief areas in said full shape compliant section substantially the same as the cross-sectional thickness of said relief areas in said transition section.

3. A compliant section, as defined by claim 1, wherein said relief areas comprise plastic-elastic hinges.

4. A compliant section, as defined by claim 3, wherein said contact is sized to be press fit into a hole within a predetermined hole size tolerance range, said plastic-elastic hinge providing a controlled region of plastic flow upon insertion of said contact into substantially any size hole within said hole size tolerance range.

5. A compliant section, as defined by claim 1, wherein said surfaces of said arm portions and said surface of said base portion are curved and lie substantially on a circle and form plural segments of said circle.

6. A compliant section, as defined by claim 1, wherein said longitudinal trough comprises an open trough in which the width of said trough decreases as the depth increases.

7. A compliant section, as defined by claim 6, wherein said arm portions substantially above said longitudinal trough, at the ends of said trough, to reduce splay.

8. In a compliant electrical contact for press fitting into a hole, a compliant section which comprises:

a first arm portion having a surface at the end thereof for engaging the inner surface of said hole upon insertion of said contact into said hole;

a second arm portion having a surface at the end thereof for engaging the inner surface of said hole upon insertion of said contact into said hole;

a base portion, between said arm portions and adjacent thereto, said base portion having a surface for engaging the inner surface of said hole upon insertion of said contact into said hole;

a single, central longitudinal trough for accommodating closure of said contact, said arm portion and said base portion forming the interior surfaces of said trough; and first and second longitudinal grooves, formed in said first and second arm portions, respectively, adjacent to said base portion, said grooves displaced from the central axis of said compliant section, and forming relief areas having a reduced cross-sectional thickness relative to that of said base portion, and also relative to the ends of said arm portions, the cross-sectional thickness of said relief areas formed by said grooves selected to provide a stress concentration at said grooves to cause said first and second arm portions to preferentially bend relative to said base portion such that said arm portions deflect inwardly towards the center of said compliant section about first and second longitudinal axes, respectively upon insertion of said contact into said hole, said first and second axes located at said first and second grooves, respectively, most of the bending of the arm portions occurring at said relief areas, and said base portion and arm portions cooperating to form a transition section at one end of said trough, said grooves extending into said transition section such that said preferential bending occurs in said transition section to initiate closure of said longitudinal trough.

9. In a compliant electrical contact for press fitting into a hole, a compliant section, comprising:

a first arm portion having a surface at the end thereof for engaging the inner surface of said hole upon insertion of said contact into said hole;

a second arm portion having a surface at the end thereof for engaging the inner surface of said hole upon insertion of said contact into said hole;

a base portion, between said arm portions and adjacent thereto, said base portion having a surface for engaging the inner surface of said hole upon insertion of said contact into said hole;

a single, central longitudinal trough for accommodating closure of said contact, said arm portion and said base portion forming the interior surfaces of said trough; and first and second relief areas, formed in said first and second arm portions, respectively, and disposed between said base portion and the ends of said arm portions, respectively, said relief areas displaced from the central axis of said compliant section, and having a reduced cross-sectional thickness relative to (i) that of said base portion and (ii) that of the ends of said arm portions, respectively, the cross-sectional thickness of said relief areas selected to provide a stress concentration at said relief areas to cause said first and second arm portions to preferentially bend relative to said base portion such that said arm portions deflect inwardly towards the center of said compliant section about first and second longitudinal axes, respectively, upon insertion of said contact into said hole, said first and second axes located at said first and second relief areas, respectively, said arm portions and said base portion forming a substantially Y-shaped cross section.

10. In a compliant press fit electrical contact, a compliant section, comprising:

an elongate member having a single longitudinal trough through the center thereof to accommodate closure of said member when said contact is pressed into a hole, said longitudinal trough formed by first and second arm portions and a base portion interposed between said arm portions and joined thereto, said base portion including a hole contact surface, said arm portions including respective hole contact surfaces at the ends thereof, the cross-sectional thickness of said first and second arm portions at the juncture of said arm portions with said base portion being (i) at least as thin as the cross-sectional thickness of said arm portions adjacent said hole contact surfaces of said arm portions, and (ii) thinner than the cross-sectional thickness of said base portion to provide first and second relief areas, respectively, for causing localized deformation in said arm portions at said relief areas, so that said arm portions preferentially yield at said relief areas more than at said base portion and the rest of said arm portions in response to interference with said hole to cause said contact to readily comply with the dimensions of said hole to thereby avoid damage to said hole.

11. A compliant section, as defined by claim 10, wherein each of said relief areas has a cross-sectional material thickness selected to provide a region of controlled plastic flow at each of said relief areas.

12. A compliant section, as defined by claim 11, wherein each of said relief areas forms a plastic-elastic hinge which extends between a full shape section and a transition section.

13. A compliant section, as defined by claim 10, wherein said longitudinal trough comprises an open trough.

14. A compliant section, as defined by claim 11, wherein each of said relief areas has a cross-sectional thickness which is thinner at said relief areas than on either side of said relief areas.

15. A compliant section, as defined by claim 10, wherein said elongate member comprises a full shaped compliant section and a transition section, said relief areas located in both said transition section and said full shaped compliant section.

16. In a compliant electrical contact for press-fitting into a hole, a compliant section, having a single, central longitudinal trough for accommodating closure of said contact, said compliant section comprising:

a full shaped compliant section;

a tapered transition section having a pair of arm portions and a base portion therebetween, which form the central longitudinal trough, said arm portions including respective hole contact surfaces at the ends thereof, said base portion including a hole contact surface, said arm portions further including respective relief areas between said base portion and the ends of said arm portions, the material thickness at said relief areas being (i) no greater than the material thickness of said arm portions adjacent said hole contact surfaces of said arm portions, (ii) less than the material thickness of said base portion, and (iii) selected to cause the arm portions of said transition section to preferentially bend at said relief areas more than at said base portion and the rest of said arm portions, to reduce resistance to closure of said central longitudinal trough during insertion of said contact in said hole.

17. A compliant section, as defined by claim 16, wherein said relief areas extend from said transition section into said full shaped section, said material thickness at said relief areas substantially the same in said full shape section as in said transition section.

18. In a compliant electrical contact, a compliant section, comprising:

an elongate member having a substantially Y-shaped cross-section said elongate member including a single central longitudinal trough in which the trough width decreases as the trough depth increases, and having an exterior surface which includes three hole contact surfaces, cross-sectionally curved to lie substantially along a circle, said elongate member also including a pair of longitudinal grooves, each of said grooves formed on said exterior surface and located between an adjacent pair of said hole contact surfaces to provide respective relief areas of reduced cross-sectional thickness, the cross-sectional thickness of each of said relief areas selected to cause said elongate member to preferentially bend along respective longitudinal hinge lines at said relief areas upon insertion of said contact into a hole.

19. In a compliant electrical contact, a compliant section comprising:

first and second arm portions, each having an end;

a base portion, interposed between said arm portions, and adjacent thereto, said arm portions and base portion forming a single, central longitudinal trough, said trough being an open trough in which the trough width decreases as the trough depth increases, said base portion and arm portions also forming respective hole contact surfaces of said compliant section, said hole contact surfaces cross-sectionally curved to lie substantially on a circle; and said first and second arm portions having respective first and second longitudinal grooves therein, adjacent to said base portion, and on respective sides thereof, to form respective relief areas in which the cross-sectional material thickness is reduced relative to the thickness of the ends of the arm portions, respectively, and relative to the base portion to cause said arm portions to preferentially bend at said relief areas upon insertion of said contact into a hole such that most of the bending of the arm portions occurs at said relief areas.

20. A compliant electrical contact, comprising:

a compliant section comprising first and second arm portions, and a base portion, interposed between said arm portions, said arm portions and base portion having hole contact surfaces and forming a central longitudinal trough in said compliant section, said arm portions projecting above the ends of said trough to reduce splay, said arm portions also including respective grooves at the respective junctions of the arm portions with the base portion, said grooves sized to provide a reduced cross-sectional material thickness which causes said arm portions to preferentially bend at said grooves upon insertion of said contact into a hole, such that most of the bending of the arm portions occurs at said grooves, said compliant section including a full shape compliant section and a tapered transition section, said grooves being in both said full shape section and said transition section; and an interconnect section, joined to said compliant section, having a central axis which is displaced from the central axis of said compliant section at the juncture of said compliant section and said interconnect section.

21. A compliant electrical contact, comprising:

a compliant section comprising first and second arm portions, and a base portion, interposed between said arm portions, said arm portions and base portion forming a central longitudinal trough in said compliant section, said trough comprising an open trough, said arm portions projecting above the ends of said trough to reduce splay, said arm portions also including respective grooves at the respective junctions of the arm portions with the base portion, said grooves sized to provide a reduced cross-sectional material thickness to cause said arm portions to preferentially bend at said grooves upon insertion of said contact into a hole, said compliant section including a full shape compliant section and a tapered transition section, said grooves in both said full shape section and said transition and formed on the exterior surfaces of said contact such that they face outwardly, and said base portion and said arm portions configured have hole contact surfaces and are to form a generally Y-shaped cross-section for said compliant section; and an interconnect section, joined to said compliant section, having a central axis which is displaced from the central axis of said compliant section at the juncture of said compliant section and said interconnect section.

22. A compliant electrical contact, as defined by claim 21, wherein said interconnect section includes a jog to substantially coaxially align the central axes at a point removed from the juncture of said compliant section and said interconnect section.

23. A compliant section, as defined by claim 8, wherein base portions and arm portions additionally form a transition section at the other end of said trough.

24. In an electrical assembly comprising a member having a hole of predetermined hole size and a compliant electrical contact sized for insertion into said hole such that said contact is retained in said hole by interference fit without substantial damage to said hole, the improvement comprising:

a compliant section, formed in said compliant electrical contact, said compliant section comprising a pair of arm portions and a base portion between said arm portions, and including a central longitudinal trough, each of said arm portions and said base portion including respective hole contact surfaces for engaging said hole during insertion of said contact into said hole such that said arm portions bend inwardly towards each other, said arm portions including respective relief areas, the cross-sectional material thickness at said relief areas being (i) thinner than the cross-sectional thickness of the base portion and (ii) selected to weaken said arm portions at said relief areas to cause said arm portions to preferentially bend at said relief areas more than at said base portion and the rest of the arm portions in response to interference of said contact with said hole, such that most of said bending of said arm portions occurs at said relief areas, and said bending causes a localized, partially plastic, deformation of material at said relief areas such that the material at said relief areas is permanently deformed after insertion of said contact into said hole, thereby causing said compliant section to readily comply to the dimensions of said hole and be retained in said hole by interference fit.

25. A compliant electrical contact comprising:

a compliant section, formed in said compliant electrical contact, said compliant section comprising a pair of arm portions and a base portion between said arm portions, and including a central longitudinal trough, each of said arm portions and said base portion including respective hole contact surfaces for engaging said hole during insertion of said contact into said hole such that said arm portions deflect inwardly towards each other, said arm portions including respective relief areas, the cross-sectional material thickness at said relief areas being (i) thinner than the cross-sectional thickness of the base portion and (ii) selected to weaken said arm portions at said relief areas to cause said arm portions preferentially bend at said relief areas more than at said base portion and the rest of the arm portions in response to interference of said contact with said hole, such that most of said bending of said arm portions occurs at said relief areas, thereby causing said compliant section to readily comply to the dimensions of said hole and be retained in said hole by interference fit.

* * * * *

UNITED STATES PATENT AND TRADEMARK OFFICE

CERTIFICATE OF CORRECTION

PATENT NO. : 4,691,979

DATED : September 8, 1987

INVENTOR(S) : Wayne E. Manska

It is certified that error appears in the above-identified patent and that said Letters Patent is hereby corrected as shown below:

Column 4, line 10, "nominal sizes" should be --nominal sized--.

Column 9, line 5, "stress.concentration" should be --stress concentration.--

Column 12, line 64, "to from" should be --to form--.

Column 13, line 67, "portions substantially" should be --portions project substantially--.

Signed and Sealed this

First Day of August, 1989

*Attest:*

*Attesting Officer*

DONALD J. QUIGG

*Commissioner of Patents and Trademarks*